US010100447B2

(12) United States Patent
Laune et al.

(10) Patent No.: US 10,100,447 B2
(45) Date of Patent: Oct. 16, 2018

(54) INSTALLATION FOR CONSOLIDATING A FIBER BATT, PARTICULARLY BY NEEDLEPUNCHING AND CONSOLIDATED NONWOVEN

(71) Applicant: ANDRITZ ASSELIN-THIBEAU S.A.S., Elbeuf (FR)

(72) Inventors: Jean-Christophe Laune, Elbeuf (FR); Hugues Leroy, Elbeuf (FR)

(73) Assignee: ANDRITZ ASSELIN-THIBEAU S.A.S., Elbeuf (FR)

( * ) Notice: Subject to any disclaimer, the term of this patent is extended or adjusted under 35 U.S.C. 154(b) by 322 days.

(21) Appl. No.: 14/858,642

(22) Filed: Sep. 18, 2015

(65) Prior Publication Data

US 2016/0083882 A1 Mar. 24, 2016

(30) Foreign Application Priority Data

Sep. 22, 2014 (FR) ..... 14 02118

(51) Int. Cl.

| | |
|---|---|
| ***D04H 18/02*** | (2012.01) |
| ***D04H 13/00*** | (2006.01) |
| ***D04H 5/02*** | (2012.01) |
| ***D04H 1/46*** | (2012.01) |
| ***D04H 3/105*** | (2012.01) |
| ***D06C 3/06*** | (2006.01) |
| ***D04H 18/00*** | (2012.01) |

(52) U.S. Cl.

CPC ..... *D04H 18/02* (2013.01); *D04H 1/46* (2013.01); *D04H 3/105* (2013.01); *D04H 5/02* (2013.01); *D04H 13/005* (2013.01); *D04H 18/00* (2013.01); *D06C 3/06* (2013.01)

(58) Field of Classification Search

CPC ..... D04H 3/105; D04H 18/02; D04H 1/46; D04H 13/005; D04H 1/48; D04H 3/102; D04H 5/02; D04H 18/00; D06C 3/06; D06C 3/00; D06C 3/067

USPC ..... 28/112

See application file for complete search history.

(56) References Cited

U.S. PATENT DOCUMENTS 4,042,655 A * 8/1977 Platt ..... D04H 1/48 264/492
4,199,644 A * 4/1980 Platt ..... D04H 18/00 156/148
4,295,251 A * 10/1981 Tatham ..... D04H 18/02 28/112

(Continued)

FOREIGN PATENT DOCUMENTS

| | | |
|---|---|---|
| EP | 1876275 A1 | 1/2008 |
| FR | 2381123 A1 | 9/1978 |
| WO | 0231245 A2 | 4/2002 |

*Primary Examiner* — Amy Vanatta

(74) *Attorney, Agent, or Firm* — Laurence A. Greenberg; Werner H. Stemer; Ralph E. Locher

(57) ABSTRACT

An installation for consolidating a batt of fibers, for example a nonwoven web, includes a mechanical consolidation workstation using needlepunching from which the fiber batt emerges in a machine or MD direction. A device is provided downstream of the consolidation workstation for stretching in the cross or CD direction which is transverse, in particular perpendicular, to the machine direction, and parallel to the plane of the batt, particularly before it is wound onto a reel. A consolidated nonwoven that can be obtained by the installation is also provided.

19 Claims, 1 Drawing Sheet

(56) References Cited

U.S. PATENT DOCUMENTS

| | | | | |
|---|---|---|---|---|
| 7,587,798 | B2 * | 9/2009 | Michalon | D04H 1/44 26/101 |
| 2002/0119720 | A1 * | 8/2002 | Arora | A61F 13/15707 442/327 |
| 2003/0021951 | A1 * | 1/2003 | Desai | A61F 13/512 428/131 |
| 2003/0181120 | A1 | 9/2003 | Wu et al. | |
| 2004/0112509 | A1 * | 6/2004 | Morman | B32B 27/12 156/163 |
| 2006/0003656 | A1 * | 1/2006 | Morman | A61F 13/4902 442/327 |
| 2009/0035527 | A1 * | 2/2009 | Kobayashi | A61F 13/15593 428/167 |
| 2009/0308524 | A1 * | 12/2009 | Gunji | B32B 5/26 156/229 |

* cited by examiner

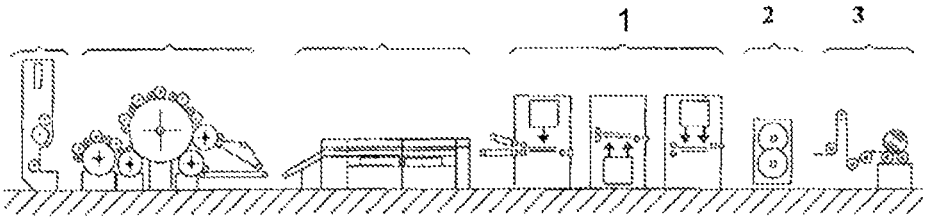
FIG.1
FIG.2
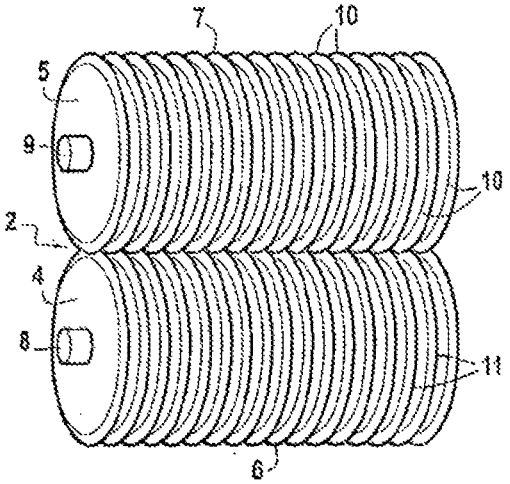
FIG.3
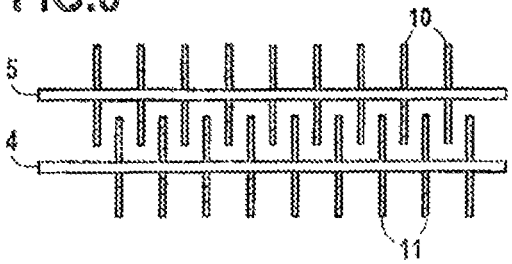
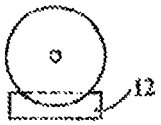
FIG.5
FIG.4
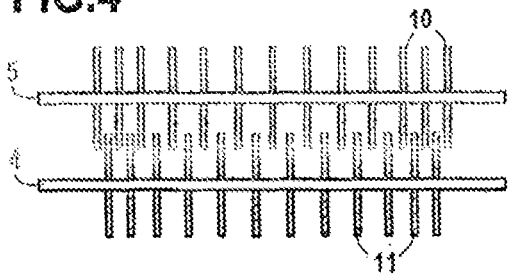
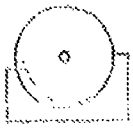
FIG.6

INSTALLATION FOR CONSOLIDATING A FIBER BATT, PARTICULARLY BY NEEDLEPUNCHING AND CONSOLIDATED NONWOVEN

CROSS-REFERENCE TO RELATED APPLICATION

This application claims the priority, under 35 U.S.C. § 119, of French Patent Application FR 14 02118, filed Sep. 22, 2014; the prior application is herewith incorporated by reference in its entirety.

BACKGROUND OF THE INVENTION

Field of the Invention

The present invention relates to an installation for consolidating a fiber batt, particularly a nonwoven web, especially by needlepunching.

The present invention also relates to a fiber batt, particularly a nonwoven web, obtained by an installation of this kind.

In numerous textile installations, and particularly in installations for the mechanical and/or hydraulic consolidation of nonwovens, for example by needlepunching or water jets, the consolidated fiber batt is difficult to convey for subsequent processing, particularly for winding onto a reel.

SUMMARY OF THE INVENTION

It is accordingly an object of the invention to provide an installation for consolidating a fiber batt, particularly by needle punching, and a consolidated nonwoven, which overcome the hereinafore-mentioned disadvantages of the heretofore-known installations and nonwovens of this general type and in which the fiber batt, particularly the nonwoven web, is simpler to convey through the installation downstream of the consolidation phase, and is particularly simpler to wind onto reels.

With the foregoing and other objects in view there is provided, in accordance with the invention, an installation for consolidating a batt of fibers, for example a nonwoven web, comprising a mechanical consolidation workstation, particularly using needlepunching, from which the fiber batt emerges in a machine direction, referred to as an MD direction. A device is provided downstream of the consolidation workstation for stretching in the cross direction which is transverse to the MD direction, particularly in the CD direction perpendicular to the MD direction and parallel to the plane of the batt, especially before it is wound onto a reel.

By thus making provision for the batt to be stretched in the cross direction CD after it has been consolidated, it has been found that subsequent processing of the batt, particularly the conveying and/or winding thereof, was easier. The inventors have understood that what was making conveying and/or winding difficult was the fact that, for example, during the consolidation by needlepunching, the batt or the nonwoven would shrink leading to a nonuniform distribution of specific density in the transverse direction, particularly into a U-shape with the batt being heavier at the edges than in the center, which distribution had detrimental effects on the stability of the conveying of the batt and particularly the winding thereof. By combating shrinkage, the consolidated nonwoven is rendered more uniform in terms of the distribution of specific density and the orientation of the fibers in the cross direction and the stability of the conveying and/or winding is thus improved. Furthermore, this stability has positive effects on the final appearance and end properties of the nonwoven, which suffers fewer defects.

In accordance with another preferred feature of the invention, the device for stretching in the CD direction is disposed in such a way that the fiber batt, particularly the nonwoven web, is stretched more at the edges than at the center of the batt, with the profile of the stretching force as a function of the transverse abscissa axis being U-shaped.

In accordance with a further preferred feature of the invention, the CD-stretch device is formed of a ringed roller, referred to as an activation roller, which includes annular rings extending in the CD direction and meshing in corresponding grooves formed in a grooved element disposed opposite the ringed roller with respect to the fiber batt, in order to thus effect cross stretching, namely stretching in the direction CD, of the batt, particularly of the nonwoven, passing between the ringed roller and the grooved element.

In accordance with an added preferred feature of the invention, the grooved element is another ringed roller, the rings of which are offset from those of the ringed roller so as to allow the rings of the two rollers to intermesh.

In accordance with an additional feature of the invention, the grooved element is an anvil, particularly a shaped anvil, in which grooves are formed and intended to partially accept the rings in order to effect cross stretching, namely stretching in the CD direction, of the batt, particularly of the nonwoven, passing between the ringed roller and the grooved anvil.

In accordance with yet another preferred feature of the invention, in order to create non-uniformity in the force of stretching in the cross direction or CD direction of the nonwoven leaving the needlepunching stage, measures are taken to ensure that the rings or discs of the activation roller or rollers are not evenly spaced apart, and particularly measures are taken to ensure that the inter-disc or inter-ring distances of the rollers are smaller towards the edges than towards the center, in order to thus increase the degree of stretch at the edges in relation to the center.

In accordance with yet a further favorable feature of the invention, in order to create non-uniformity in the force of stretching in the cross direction or CD direction of the nonwoven leaving the needlepunching stage, measures are taken to ensure that the rings or discs of the activation roller or rollers do not have a diameter that is constant from one disc to the next in the CD direction, and particularly measures are taken to ensure that the diameters of the discs or rings of the roller or rollers are smaller towards the center than towards the edges, for example they increase from the center towards the edges, in order to thus increase the degree of stretch at the edges in relation to the center.

With the objects of the invention in view, there is concomitantly provided a consolidated nonwoven obtained by the installation according to the invention, particularly in the condition in which it is wound onto a reel.

Other features which are considered as characteristic for the invention are set forth in the appended claims.

Although the invention is illustrated and described herein as embodied in an installation for consolidating a fiber batt, particularly by needlepunching, and a consolidated nonwoven, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a diagrammatic, overall longitudinal-sectional view of an installation for consolidating a nonwoven by needlepunching according to one embodiment of the invention;

FIG. 2 is a perspective view of a cross-stretching device that can be used in the installation of FIG. 1;

FIG. 3 is a longitudinal-sectional view of the upper and lower two activation rollers of the stretching device of FIG. 2;

FIG. 4 is a view identical to FIG. 3 according to another embodiment of the invention;

FIG. 5 is a cross-sectional view of an alternative embodiment including a single activation roller opposite an anvil having a corresponding series of ribs; and FIG. 6 depicts an alternative form of the embodiment of FIG. 5 that allows progressive cross stretching according to the shape of the ribs.

DETAILED DESCRIPTION OF THE INVENTION

Referring now to the figures of the drawings in detail and first, particularly, to FIG. 1 thereof, there is seen an outline diagram depicting an installation for consolidating a nonwoven by needlepunching according to the invention. The installation at its inlet includes a fleece former and spreader (itself fed in the conventional way from a carding machine), which conveys a nonwoven web through one or more needlepunching machines 1. At the exit from the needlepunching machine, in which the nonwoven has been consolidated by being punctured by needles from a needleboard given a reciprocating movement at right angles to the direction in which the web is being conveyed, the nonwoven is introduced into a cross direction or CD stretching device 2 so that the nonwoven leaving the needlepunching machine can be stretched in the CD direction. Upon leaving the stretching device, the nonwoven is sent to a winder 3 in which the nonwoven is wound, particularly onto a reel.

The position of the transverse stretcher in the line can vary from one installation to another. Likewise, the cross stretcher may be situated at a number of points on the line, particularly after each consolidation device.

The stretching device 2 is depicted in greater detail in FIG. 2. It is formed of two ringed rollers, which are respectively a lower roller 4 and an upper roller 5, the rings 6, 7 of which are offset from one roller to another in order to allow them to intermesh. The two rollers are made from a respective shaft 8, 9 and a plurality of discs 10, 11, the outer edges of which form the rings. Thus, the rings extend along the shaft of each of the rollers and do so over the entire axial circular periphery.

When the nonwoven passes through the nip between the two rollers it finds itself stretched in the CD direction, namely in a direction parallel to the axis of the rollers.

FIG. 3 depicts the two rollers 4 and 5 in a diagrammatic view. The discs 10, 11 of the upper and lower rollers 5, 4 which form the rings 7, 6 of the rollers that mesh with the discs that form the rings of the other roller are disposed in such a way as to be substantially equal distances apart in the CD direction. This results in stretching that is substantially uniform along the axis CD.

According to a refinement of the invention depicted in FIG. 4, measures may also be taken to ensure that the discs 10, 11 are more closely spaced in the CD direction towards the edge parts, which means to say left and right edges, of the nonwoven by comparison with the center. Thus, the distance between adjacent or successive discs at the right and left edges is smaller than the distance between adjacent or successive discs situated substantially at the center of the nonwoven passing between the two rollers. Thus, the magnitude of the force of stretching in the CD direction at the edges is greater than at the center.

According to one particularly preferred embodiment, the distance between two discs forming successive rings decreases with distance away from the center of the nonwoven and therefore substantially from the middle of the cylinder towards each of the respective left and right edges, so that the curve giving the magnitude of the cross stretching force as a function of position in the CD direction is U-shaped. Knowing that the curve giving the local mass per unit area or specific density as a function of position along the CD axis of the nonwoven leaving the needlepunching machine is U-shaped, the mass per unit area is thus evened out. The stability of the nonwoven during subsequent conveying operations is thus improved and this particularly assists with winding by combating a chord effect that is found in the devices of the prior art.

It should also be noted that by providing such a stretching device, the objective of which is generally to stretch the nonwoven at the output by an amount of stretch of 5 to 20%, particularly of around 10%, it is possible to dispense with the need for the needlepunching device to be dimensioned over-generously, thereby limiting the costs of the installation which are greatly dependent on the surface area of needles in the needlepunching device.

The consolidated nonwoven obtained at the output from the installation, after having been stretched, has a transverse profile of substantially uniform mass per unit area, with the difference between the local mass per unit area at an edge or at the edges being particularly substantially identical to that at the center, particularly differing by under 10%, particularly under 5%.

According to other embodiments depicted in FIGS. 5 and 6, one of the two disc rollers can be replaced by an anvil 12, particularly a fixed anvil, in which grooves have been made to partially accept the rings of the other roller.

According to yet another embodiment which has not been depicted, which can be implemented in combination with the other embodiments or on its own, measures may be taken to ensure that the discs of the roller or each roller have a diameter that varies from the edge towards the center in order to thus vary the cross-stretching force from the edge towards the center.

According to yet another embodiment which has not been depicted, the rings and the corresponding grooves may be formed by a system of combs or strips which are some distance apart.

The invention claimed is:

1. An installation for consolidating a batt of fibers or a nonwoven web, the installation extending along a machine direction between an installation entry point and an installation output point and comprising:

a fiber batt or nonwoven web extending from the installation entry point to the installation output point;

a mechanical consolidation workstation using needlepunching from which the fiber batt or nonwoven web emerges in the machine direction; and a cross direction stretching device disposed directly downstream of said consolidation workstation for stretching the fiber batt or nonwoven web in a cross direction transverse to said machine direction, said stretching device including a ringed activation roller having rings disposed along said cross direction;

a grooved element disposed opposite said activation roller relative to the fiber batt or nonwoven web, said grooved element having grooves formed therein corresponding to said rings in which said rings mesh for cross stretching the fiber batt or non woven web in the cross direction as the fiber batt or nonwoven web passes between said roller and said grooved element;

the batt of fibers or nonwoven web having a first width in said cross direction entering said stretching device and a second width in said cross direction exiting said stretching device, said second width being greater than said first width.

2. The installation according to claim 1, wherein said cross direction is perpendicular to said machine direction and parallel to a plane of the fiber batt or nonwoven web.

3. The installation according to claim 1, which further comprises a reel onto which the fiber batt or nonwoven web is wound downstream of said stretching device.

4. The installation according to claim 1, wherein said device for stretching in said cross direction is configured to stretch the fiber batt or nonwoven web more at the edges than at the center of the fiber batt or nonwoven web and forms a U-shaped profile of a stretching force as a function of a transverse abscissa axis.

5. The installation according to claim 1, wherein:

said second width is 5 to 20% larger than said first width.

6. The installation according to claim 1, wherein said grooved element is another ringed activation roller having rings being offset from said rings of said ringed activation roller to allow said rings of said rollers to intermesh.

7. The installation according to claim 1, wherein said grooved element is an anvil having grooves formed therein and configured to partially receive said rings to effect cross stretching in said cross direction of the fiber batt or nonwoven web passing between said ringed roller and said grooved anvil.

8. The installation according to claim 7, wherein said anvil is a shaped anvil.

9. The installation according to claim 1, wherein said rings of said ringed activation roller are unevenly spaced apart to increase a degree of stretch at the edges relative to the center of the fiber batt or nonwoven web and to create non-uniformity in a force of stretching in said cross direction of the fiber batt or nonwoven web leaving said mechanical consolidation workstation using needlepunching.

10. The installation according to claim 9, wherein said rings have inter-ring distances being smaller towards the edges than towards the center of the fiber batt or nonwoven web.

11. The installation according to claim 6, wherein said rings of said ringed activation rollers are unevenly spaced apart to increase a degree of stretch at the edges relative to the center of the fiber batt or nonwoven web and to create non-uniformity in a force of stretching in said cross direction of the fiber batt or nonwoven web leaving said mechanical consolidation workstation using needlepunching.

12. The installation according to claim 11, wherein said rings have inter-ring distances being smaller towards the edges than towards the center of the fiber batt or nonwoven web.

13. The installation according to claim 1, wherein said rings of said ringed activation roller have a non-constant diameter from one ring to the next along said cross direction to increase a degree of stretch at the edges relative to the center of the fiber batt or nonwoven web and to create non-uniformity in a force of stretching in said cross direction of the fiber batt or nonwoven web leaving said mechanical consolidation workstation using needlepunching.

14. The installation according to claim 13, wherein said diameters of said rings of said roller are larger towards the edges than towards the center of the fiber batt or nonwoven web.

15. The installation according to claim 13, wherein said diameters of said rings of said roller increase from the center towards the edges of the fiber batt or nonwoven web.

16. The installation according to claim 6, wherein said rings of said ringed activation rollers have a non-constant diameter from one ring to the next along said cross direction to increase a degree of stretch at the edges relative to the center of the fiber batt or nonwoven web and to create non-uniformity in a force of stretching in said cross direction of the fiber batt or nonwoven web leaving said mechanical consolidation workstation using needlepunching.

17. The installation according to claim 16, wherein said diameters of said rings of said rollers are larger towards the edges than towards the center of the fiber batt or nonwoven web.

18. The installation according to claim 16, wherein said diameters of said rings of said rollers increase from the center towards the edges of the fiber batt or nonwoven web.

19. The installation according to claim 1, wherein said rings are discs.

* * * * *